US008967837B2

(12) United States Patent
Tsuei et al.

(10) Patent No.: US 8,967,837 B2
(45) Date of Patent: Mar. 3, 2015

(54) SOLID STATE LIGHT WITH FEATURES FOR CONTROLLING LIGHT DISTRIBUTION AND AIR COOLING CHANNELS

(71) Applicant: 3M Innovative Properties Company, St. Paul, MN (US)

(72) Inventors: Alexander C. Tsuei, Woodbury, MN (US); James F. Poch, Ellsworth, WI (US); Paul E. Humpal, Stillwater, MN (US); Hamid R. Mortazavi, Woodbury, MN (US); Robert L. Brott, Woodbury, MA (US); Raymond P. Johnston, Lake Elmo, MN (US)

(73) Assignee: 3M Innovative Properties Company, Saint Paul, MN (US)

( * ) Notice: Subject to any disclaimer, the term of this patent is extended or adjusted under 35 U.S.C. 154(b) by 0 days.

(21) Appl. No.: 13/956,562

(22) Filed: Aug. 1, 2013

(65) Prior Publication Data

US 2015/0036333 A1 Feb. 5, 2015

(51) Int. Cl.
*F21V 5/00* (2006.01)
*F21K 99/00* (2010.01)

(52) U.S. Cl.
CPC ..... *F21K 9/1355* (2013.01); *F21K 9/50* (2013.01)
USPC ..... 362/311.05; 362/294; 362/311.02; 362/235

(58) Field of Classification Search
USPC ..... 362/294, 373, 249.02, 311.02; 313/45, 313/46
See application file for complete search history.

(56) References Cited

U.S. PATENT DOCUMENTS

| | | | | |
|---|---|---|---|---|
| 7,160,012 | B2 | 1/2007 | Hilscher | |
| 7,581,856 | B2 | 9/2009 | Kang | |
| 7,607,802 | B2 | 10/2009 | Kang | |
| 7,628,512 | B2 * | 12/2009 | Netzel et al. | 362/267 |
| 7,628,513 | B2 * | 12/2009 | Chiu | 362/311.02 |
| 8,360,604 | B2 | 1/2013 | Negley | |
| 8,487,518 | B2 | 7/2013 | Johnston | |
| 8,702,272 | B2 | 4/2014 | Chuang | |
| 8,827,504 | B2 | 9/2014 | Parker | |
| 2004/0201990 | A1 | 10/2004 | Meyer | |
| 2005/0105302 | A1 | 5/2005 | Hofmann | |
| 2007/0014549 | A1 | 1/2007 | Demarest | |
| 2008/0049399 | A1 | 2/2008 | Lu | |
| 2008/0253125 | A1 | 10/2008 | Kang | |
| 2010/0148652 | A1 | 6/2010 | Vetrovec | |

(Continued)

FOREIGN PATENT DOCUMENTS

| | | |
|---|---|---|
| DE | 20 2007 009 272 | 11/2007 |
| EP | 2025992 | 2/2009 |

(Continued)

OTHER PUBLICATIONS

PCT International Search Report for PCT/US2014/048419, mailed Nov. 10, 2014.

*Primary Examiner* — Ali Alavi

(57) ABSTRACT

A solid state light having a shell forming an interior volume and with surface texture for redirecting light. A light section is coupled to the shell, and a light source board in the light section includes at least one solid state light source such as an LED. The shell, light section, and light source board have apertures for providing an air cooling channel through the light. The solid state light source transmits light into the interior volume, and the light exits from the shell and is redirected by the surface texture, providing for various light distribution curves of the light.

30 Claims, 12 Drawing Sheets

(56) References Cited

U.S. PATENT DOCUMENTS

| | | | | |
|---|---|---|---|---|
| 2010/0181888 | A1 | 7/2010 | Lu | |
| 2010/0246166 | A1 | 9/2010 | Hsu | |
| 2010/0264800 | A1 | 10/2010 | Liu | |
| 2011/0032708 | A1 | 2/2011 | Johnston | |
| 2011/0101861 | A1 | 5/2011 | Yoo | |
| 2011/0298371 | A1 | 12/2011 | Brandes | |
| 2012/0139358 | A1* | 6/2012 | Teggatz et al. | 307/104 |
| 2012/0194054 | A1 | 8/2012 | Johnston | |
| 2013/0038195 | A1 | 2/2013 | Petroski | |
| 2013/0113358 | A1 | 5/2013 | Progl | |

FOREIGN PATENT DOCUMENTS

| | | |
|---|---|---|
| WO | WO 2010-058325 | 5/2010 |
| WO | WO 2010-146746 | 12/2010 |
| WO | WO 2012-139358 | 10/2012 |

* cited by examiner

SOLID STATE LIGHT WITH FEATURES FOR CONTROLLING LIGHT DISTRIBUTION AND AIR COOLING CHANNELS

BACKGROUND

The energy efficiency of lighting has become an important consideration in industrial, consumer, and architectural lighting applications. With the advances in solid state light technology, light emitting diodes (LEDs) have become more energy efficient than fluorescent lights. Further, the marketplace has a large established fixture base for Edison, fluorescent and high intensity discharge lights. These types of applications present a significant technical challenge for LEDs due to their inherent point source nature, and the need to operate the LEDs at relatively low temperatures. Today there are many solutions addressing these issues, including fans, thermal sinks, heat pipes and the like. However, these approaches limit the applications by adding complexity, cost, efficiency loss, added failure modes, an undesirable form factor, and light distribution. The need remains to find a solution that can provide optical and electrical efficiency benefits, at attractive manufacturing costs and design.

SUMMARY

A first solid state light, consistent with the present invention, includes a shell having an interior volume and surface texture, a light section coupled to the shell, and a light source board coupled to the light section. At least one solid state light source is on the light source board and transmits light into the interior volume. At least a portion of the light exits from the shell and is redirected by the texture.

A second solid state light, consistent with the present invention, includes a shell having an interior volume and surface texture, a light section coupled to the shell, and a light source board coupled to the light section. At least one solid state light source is on the light source board at an edge of the shell. The light source transmits light into the edge and into the interior volume. At least a portion of the light exits from the shell and is redirected by the texture.

A third solid state light, consistent with the present invention, includes a shell having an interior volume, a light section coupled to the shell, and a light source board coupled to the light section. A first solid state light source is on the light source board at an edge of the shell, and a second solid state light source is on the light source board within or adjacent the interior volume. The first light source transmits light into the edge, the second light source transmits light into the interior volume, and at least a portion of the light from the first and second light sources exits from the shell.

A fourth solid state light, consistent with the present invention, includes a shell having an interior volume and surface texture, a light section coupled to the shell, a light source board coupled to the light section, and a pedestal heat sink on the light source board. At least one solid state light source is on the pedestal heat sink and transmits light into the interior volume. At least a portion of the light exits from the shell and is redirected by the texture.

BRIEF DESCRIPTION OF THE DRAWINGS

The accompanying drawings are incorporated in and constitute a part of this specification and, together with the description, explain the advantages and principles of the invention. In the drawings.

DETAILED DESCRIPTION

Embodiments of the present invention include an LED light bulb having advanced bulb shells, small-size heat sinks, and various configurations of LEDs or other solid state light sources. The advanced bulb shells can contain surface texture or optical transflective films to control the light distribution from the bulb. The light bulb is equipped with cooling air channels that aid in the dissipation of the heat. The LED light sources can be configured in various ways, and the lights can include various features, to optimize the performance and light distribution curve of the light bulb.

Examples of solid state lights are described in the following, all of which are incorporated herein by reference as if fully set forth: U.S. Pat. No. 8,487,518; and U.S. Patent Applications Publication Nos. 2012/0194054 and 2011/0032708.

Figure 1:
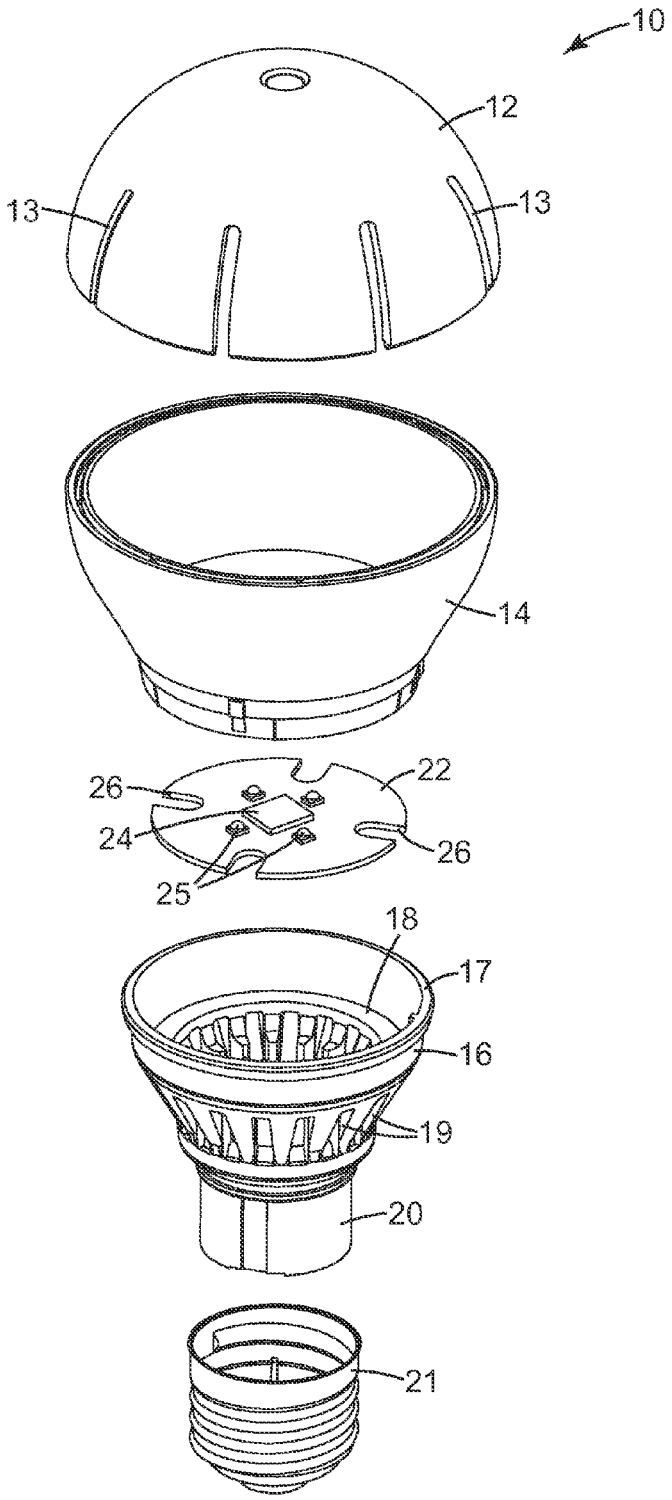
FIG. 1 is an exploded perspective view of a first embodiment of a solid state light having a light source board with vents.
Figure 2:
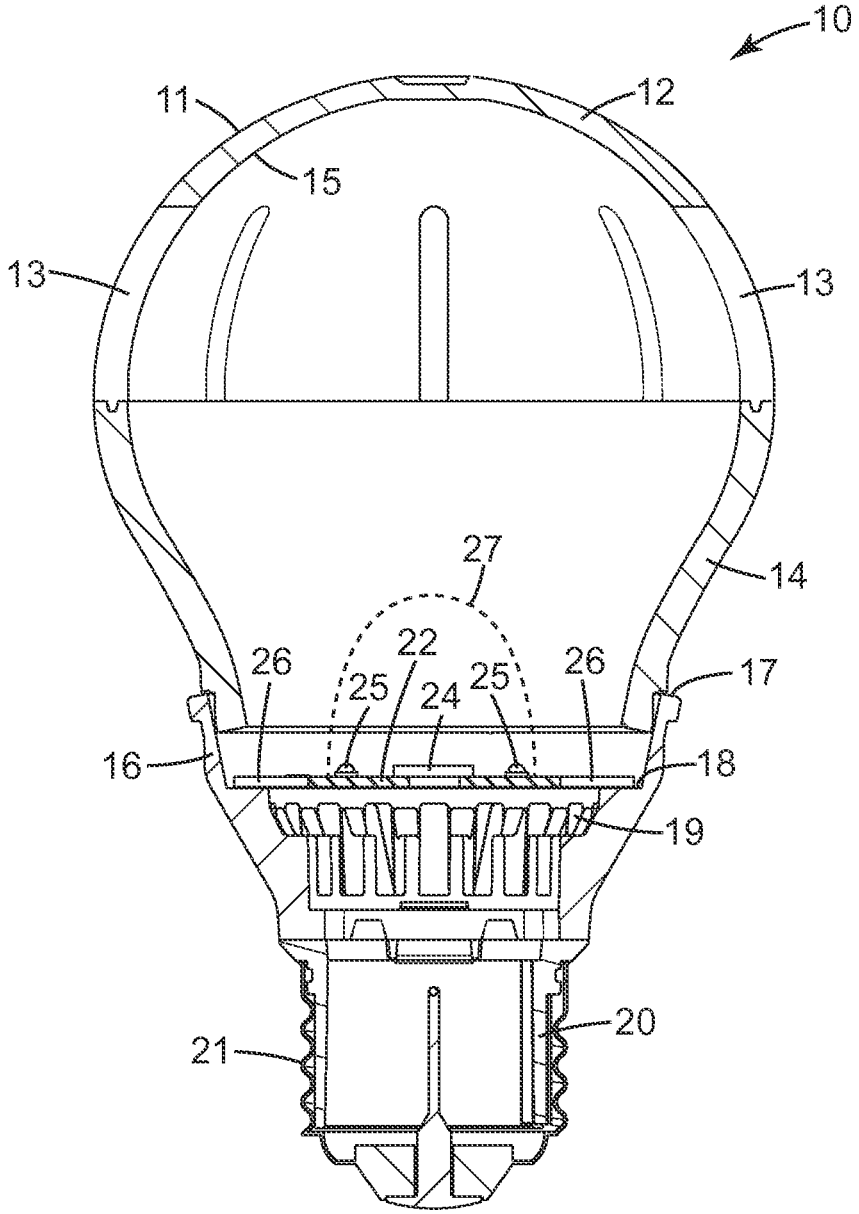
FIG. 2 is a side sectional view of the first embodiment.

FIGS. 1 and 2 are exploded perspective and side sectional views, respectively, of a first embodiment of a solid state light 10 having a light source board with vents. Light 10 includes a shell having an upper portion 12 and a lower portion 14. Upper portion 12 has one or more apertures (vents) 13. The shell has a first surface 11 and a second surface 15 opposite first surface 11 and an edge between the surfaces. Second surface 15 forms an interior volume of the shell.

A light section 16 includes a ridge 17, a ridge 18, and one or more apertures (vents) 19. Ridge 17 provides support for the shell at the edge formed by first and second surfaces 11 and 15 when upper and lower portions 12 and 14 are mated together. Ridge 18 provides support for a light source board 22. Light section 16 also includes a base portion 20. A base 21 is attached to base portion 20 and provides for connection to a power source.

Light source board 22 includes solid state light sources 25 and a driver 24 for controlling the light sources. Light source board 22 also includes one or more apertures (vents) 26, which provide for air flow between light section 16 and the interior volume of the shell when light source board 22 is mounted on ridge 18. Apertures 26 also provide for air flow between apertures 13 and 19 such that air flow is provided through the light for cooling the light. Air flow is also provided through the light by apertures 13 providing for air flow into and out of the interior volume of the shell and apertures 19 providing for air flow into and out of light section 16. Light sources 25 transmit light into the interior volume of the shell and through the shell such that at least a portion of the light is distributed from the first surface to provide for illumination from the light.

Light 10 can optionally include a light mixing chamber 27 over light sources 25. For example, light mixing chamber 27 can be implemented with a transparent or translucent dome-shaped covering over light sources 25 to provide light mixing before the light from light sources 25 is transmitted through the interior volume to the shell. Light mixing chamber 27 can include texture on its inner surface, outer surface, or both inner and outer surfaces. Examples of texture are provided below.

Figure 3:
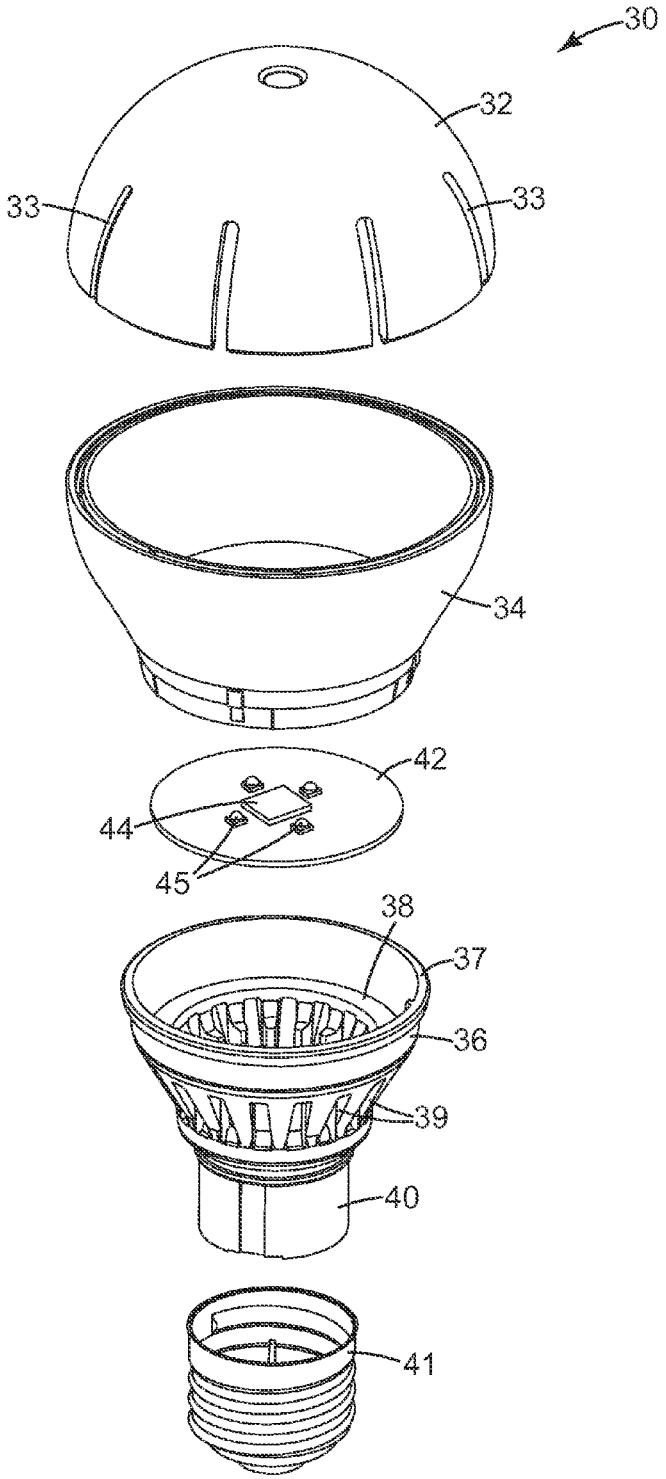
FIG. 3 is an exploded perspective view of a second embodiment of a solid state light having a light source board without vents.
Figure 4:
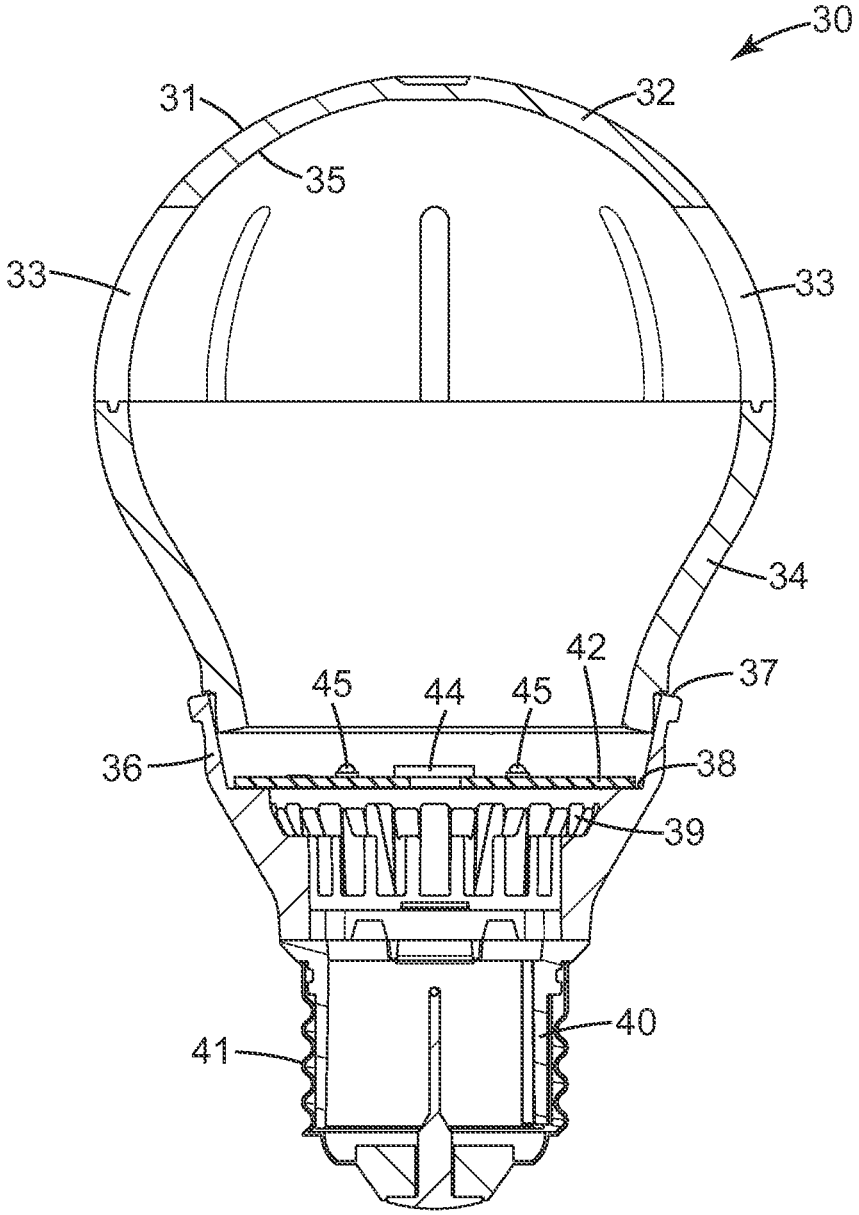
FIG. 4 is a side sectional view of the second embodiment.

FIGS. 3 and 4 are exploded perspective and side sectional views, respectively, of a second embodiment of a solid state light 30 having a light source board without vents. Light 30 includes a shell having an upper portion 32 and a lower portion 34. Upper portion 32 has one or more apertures (vents) 33. The shell has a first surface 31 and a second surface 35 opposite first surface 31 and an edge between the surfaces. Second surface 35 forms an interior volume of the shell.

A light section 36 includes a ridge 37, a ridge 38, and one or more apertures (vents) 39. Ridge 37 provides support for the shell at the edge formed by first and second surfaces 31 and 35 when upper and lower portions 32 and 34 are mated together. Ridge 38 provides support for a light source board 42. Light section 36 also includes a base portion 40. A base 41 is attached to base portion 40 and provides for connection to a power source.

Light source board 42 includes solid state light sources 45 and a driver 44 for controlling the light sources. Light source board 42 does not include apertures and thus does not allow air flow between light section 36 and the interior volume of the shell when light source board 42 is mounted on ridge 38. Air flow is provided through the light for cooling the light by apertures 33 providing for air flow into and out of the interior volume of the shell and apertures 39 providing for air flow into and out of light section 36. Light sources 45 transmit light into the interior volume of the shell and through the shell such that at least a portion of the light is distributed from the first surface to provide for illumination from the light.

Figure 5:
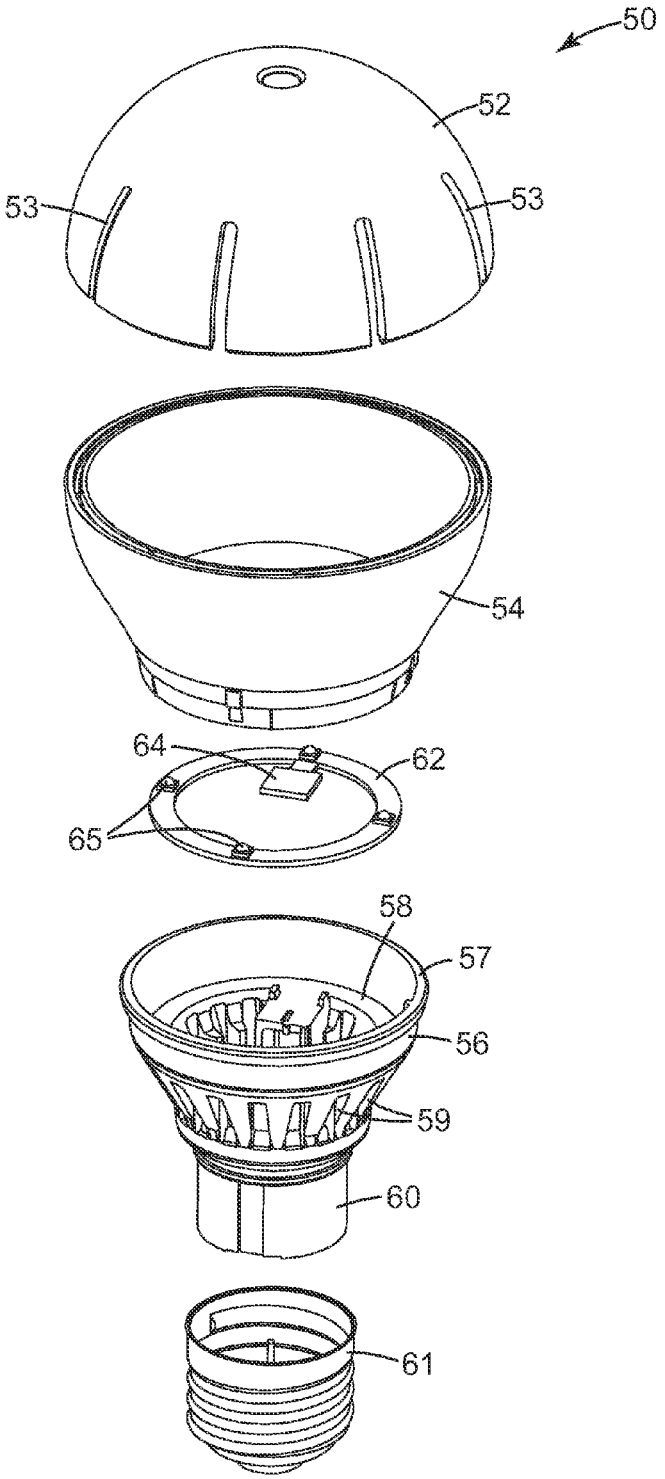
FIG. 5 is an exploded perspective view of a third embodiment of a solid state light having an alternative light source board.
Figure 6:
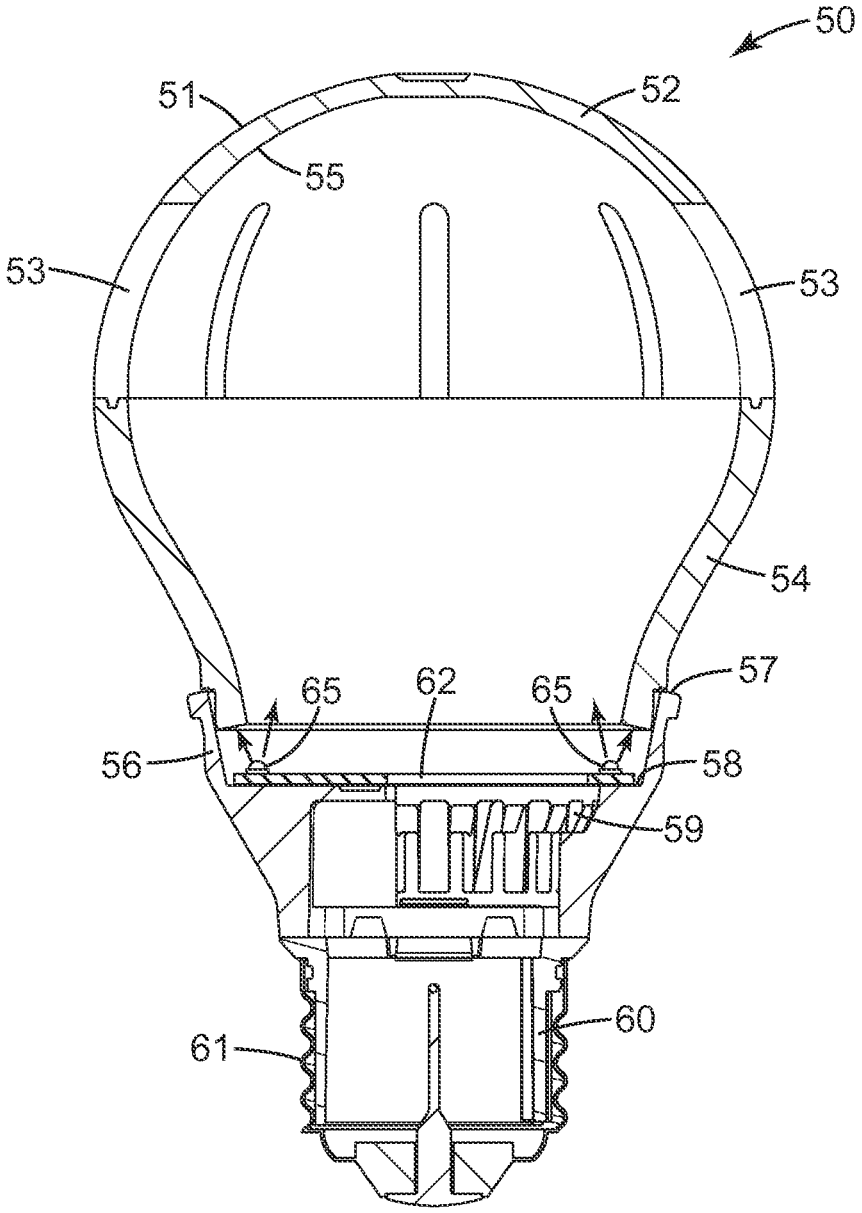
FIG. 6 is a side sectional view of the third embodiment.

FIGS. 5 and 6 are exploded perspective and side sectional views, respectively, of a third embodiment of a solid state light 50 having an alternative light source board. Light 50 includes a shell having an upper portion 52 and a lower portion 54. Upper portion 52 has one or more apertures (vents) 53. The shell has a first surface 51 and a second surface 55 opposite first surface 51 and an edge between the surfaces. Second surface 55 forms an interior volume of the shell.

A light section 56 includes a ridge 57, a ridge 58, and one or more apertures (vents) 59. Ridge 57 provides support for the shell at the edge formed by first and second surfaces 51 and 55 when upper and lower portions 52 and 54 are mated together. Ridge 58 provides support for a light source board 62. Light section 56 also includes a base portion 60. A base 61 is attached to base portion 60 and provides for connection to a power source.

Light source board 62 includes solid state light sources 65 and a driver 64 for controlling the light sources. Light source board 62 also includes a center opening, which provides for air flow between light section 56 and the interior volume of the shell when light source board 62 is mounted on ridge 58. The opening in light source board 62 also provides for air flow between apertures 53 and 59 such that air flow is provided through the light for cooling the light. Air flow is also provided through the light by apertures 53 providing for air flow into and out of the interior volume of the shell and apertures 59 providing for air flow into and out of light section 56. Light source board 62 can have a ring shape, as shown, or other shapes depending upon the shape of light section 56.

Light sources 65 are located at least partially at the edge of the shell formed by first and second surfaces 51 and 55. An optional gap can exist between light sources 65 and the edge. Some light from light sources 65 is transmitted and optically coupled into the shell at the edge, and transmitted through the shell, for example by total internal reflection, until the light exits from first surface 51 or second surface 55. Some light from light sources 65 is transmitted into the interior volume of the shell. At least a portion of the light transmitted into the edge and the interior volume is distributed from the first surface to provide for illumination from the light.

Figure 7:
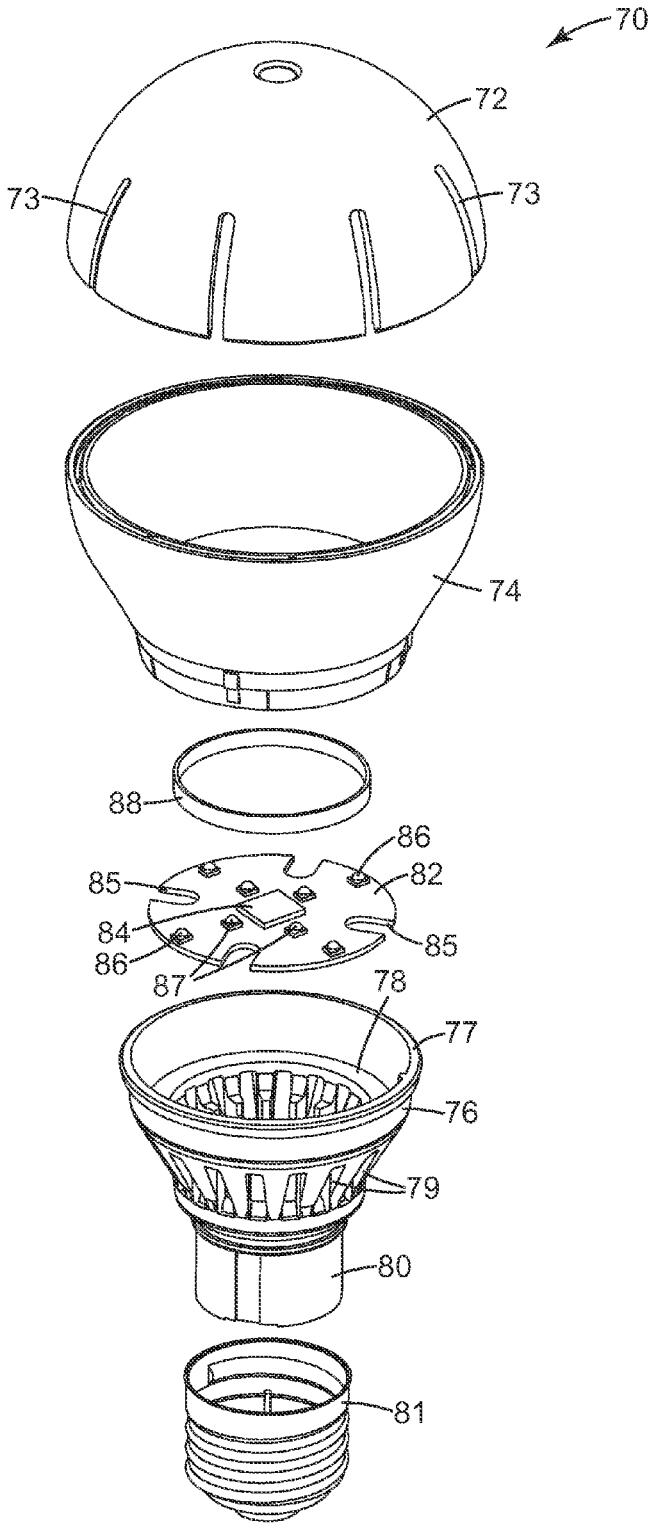
FIG. 7 is an exploded perspective view of a fourth embodiment of a solid state light using light transport through the shell edge and interior volume to distribute light.
Figure 8:
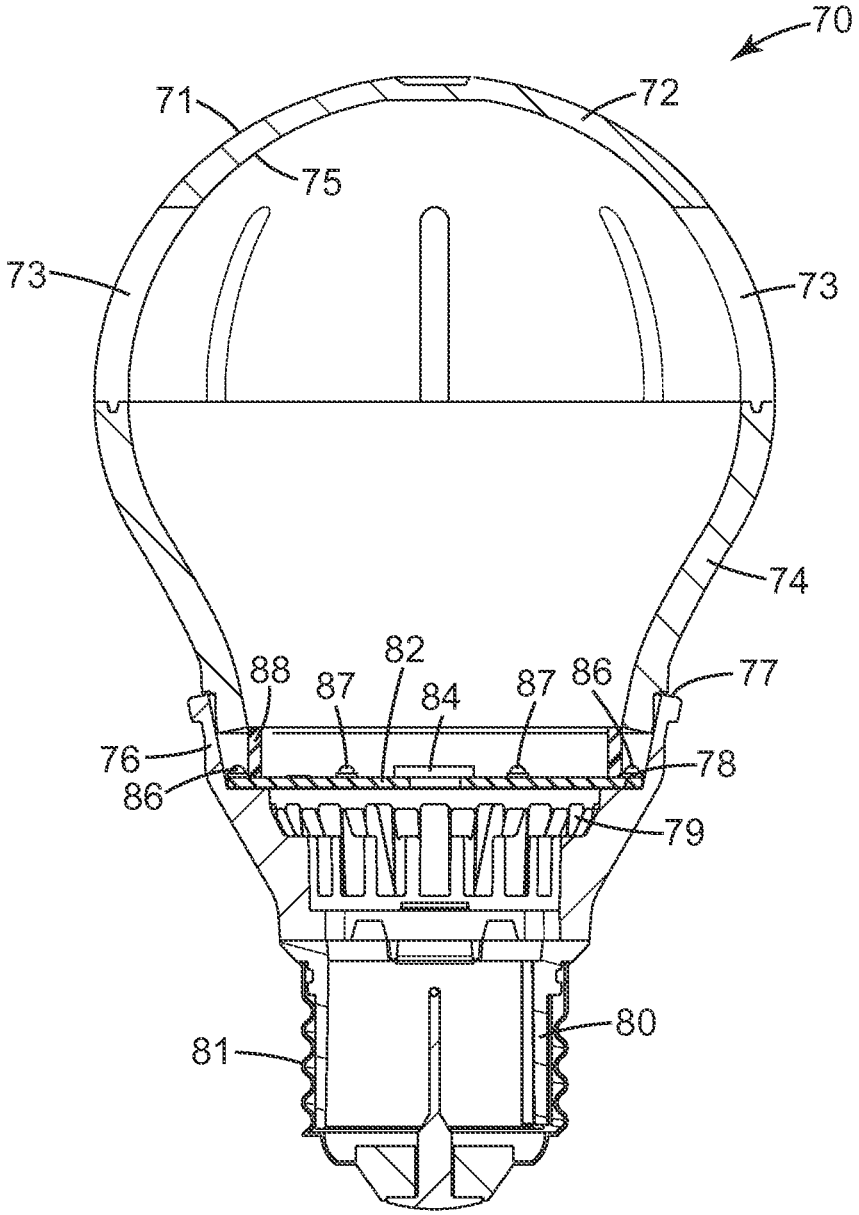
FIG. 8 is a side sectional view of the fourth embodiment.

FIGS. 7 and 8 are exploded perspective and side sectional views, respectively, of a fourth embodiment of a solid state light 70 using light transport through the shell edge and interior volume to distribute light. Light 70 includes a shell having an upper portion 72 and a lower portion 74. Upper portion 72 has one or more apertures (vents) 73. The shell has a first surface 71 and a second surface 75 opposite first surface 71 and an edge between the surfaces. Second surface 75 forms an interior volume of the shell.

A light section 76 includes a ridge 77, a ridge 78, and one or more apertures (vents) 79. Ridge 77 provides support for the shell at the edge formed by first and second surfaces 71 and 75 when upper and lower portions 72 and 74 are mated together. Ridge 78 provides support for a light source board 82. Light section 76 also includes a base portion 80. A base 81 is attached to base portion 80 and provides for connection to a power source.

Light source board 82 includes solid state light sources 86 and 87, and a driver 84 for controlling the light sources. Light source board 82 also includes one or more apertures (vents) 85, which provide for air flow between light section 76 and the interior volume of the shell when light source board 82 is mounted on ridge 78. Apertures 85 also provide for air flow between apertures 73 and 79 such that air flow is provided through the light for cooling the light. Air flow is also provided through the light by apertures 73 providing for air flow into and out of the interior volume of the shell and apertures 79 providing for air flow into and out of light section 76.

Light sources 86 are located at the edge of the shell optionally with a gap between the light sources and the edge. Light sources 86 transmit light into the shell at the edge. The light from light sources 86 is optically coupled into the shell at the edge and transported within the shell, for example by total internal reflection, until the light exits from first surface 71 or second surface 75. Light sources 87 are located adjacent or within the interior volume of the shell. Light from light sources 87 is transmitted into the interior volume and through the shell. An optional reflective material 88, for example a metal ring or reflective film, can be located between light sources 86 and 87. An example of a reflective film is the Enhanced Specular Reflective (ESR) film product from 3M Company, St. Paul, Minn. At least a portion of the light transmitted into the edge and the interior volume is distributed from the first surface to provide for illumination from the light.

Figure 9:
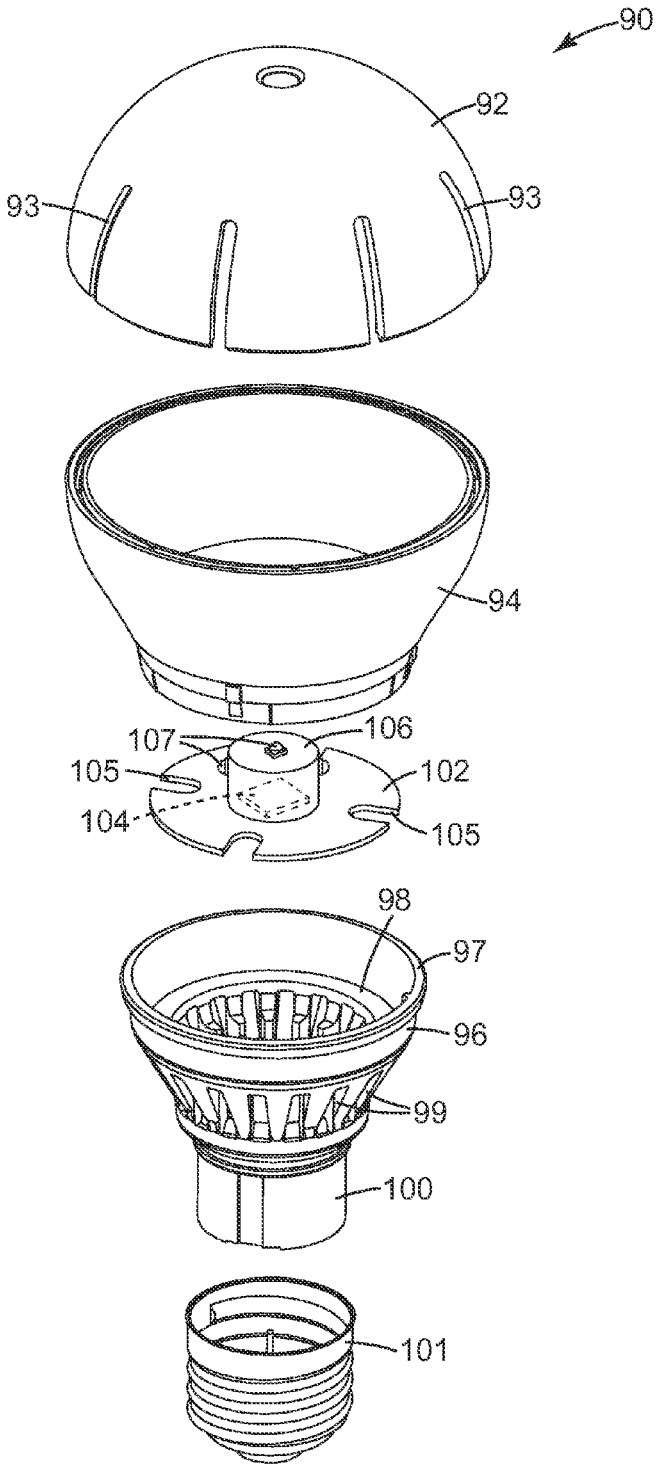
FIG. 9 is an exploded perspective view of a fifth embodiment of a solid state light having a pedestal heat sink for light sources.
Figure 10:
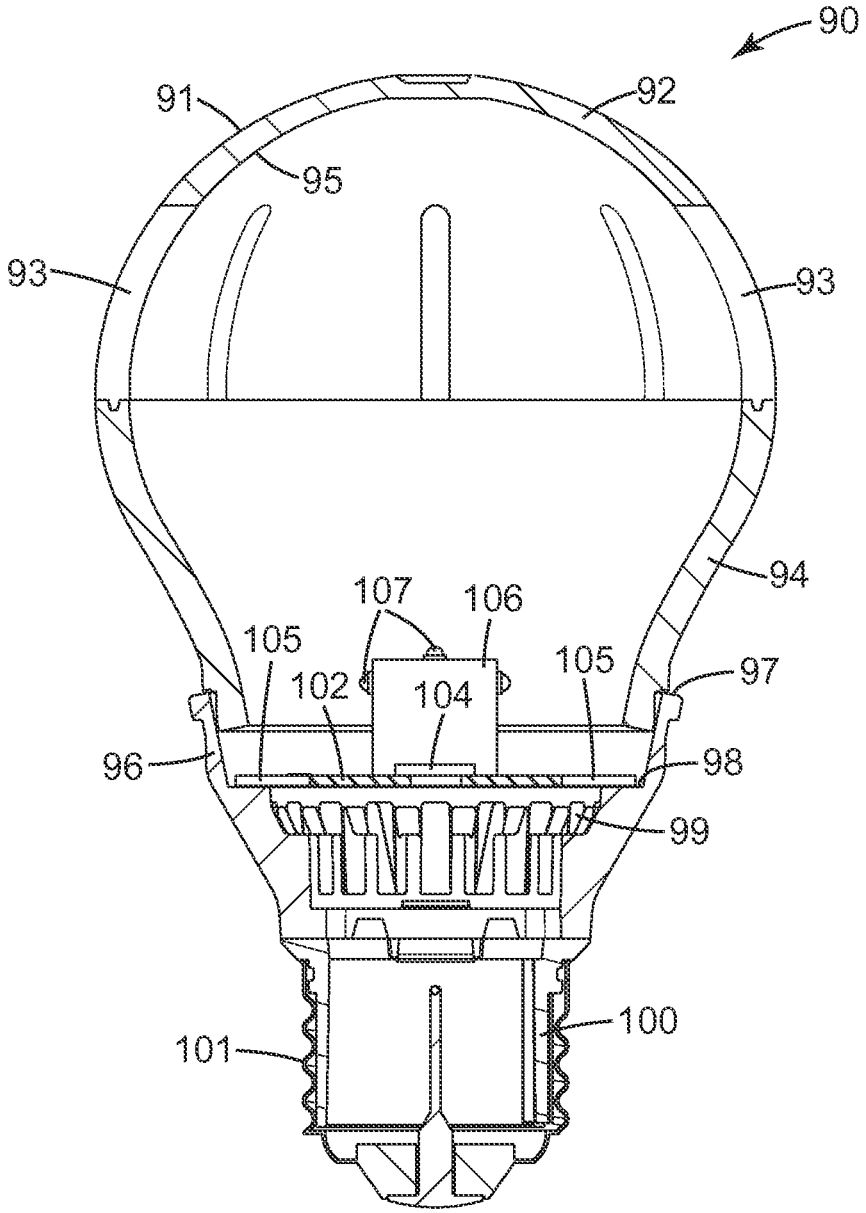
FIG. 10 is a side sectional view of the fifth embodiment.

FIGS. 9 and 10 are exploded perspective and side sectional views, respectively, of a fifth embodiment of a solid state light 90 having a pedestal heat sink for light sources. Light 90 includes a shell having an upper portion 92 and a lower portion 94. Upper portion 92 has one or more apertures (vents) 93. The shell has a first surface 91 and a second surface 95 opposite first surface 91 and an edge between the surfaces. Second surface 95 forms an interior volume of the shell.

A light section 96 includes a ridge 97, a ridge 98, and one or more apertures (vents) 99. Ridge 97 provides support for the shell at the edge formed by first and second surfaces 91 and 95 when upper and lower portions 92 and 94 are mated together. Ridge 98 provides support for a light source board 102. Light section 96 also includes a base portion 100. A base 101 is attached to base portion 100 and provides for connection to a power source.

Light source board 102 includes solid state light sources 107 on a pedestal heat sink 106 and a driver 104 for controlling the light sources. Light source board 102 also includes one or more apertures (vents) 105, which provide for air flow between light section 96 and the interior volume of the shell when light source board 102 is mounted on ridge 98. Apertures 105 also provide for air flow between apertures 93 and 99 such that air flow is provided through the light for cooling the light. Air flow is also provided through the light by apertures 93 providing for air flow into and out of the interior volume of the shell and apertures 99 providing for air flow into and out of light section 96. Light sources 107 transmit light from the interior volume of the shell through the shell such that at least a portion of the light is distributed from the first surface to provide for illumination from the light.

Pedestal heat sink 106 is in sufficient contact, directly or indirectly, with solid state light sources 107 in order to conduct and dissipate heat from the solid state light sources. Heat sink 106 can be directly in physical contact with solid state light sources 107 or indirectly in contact with them such as through other components. Heat sink 106 can be implemented with a metal material such as aluminum. The heat sink can also be implemented with other metal materials, ceramic materials, or combinations of metals and ceramics. The heat sink can be hollow, as shown, in order to provide a space for driver circuit 104 and a cap over the driver circuit. Alternatively, if the driver circuit is located elsewhere, the heat sink can be composed of a solid material.

Figure 11:
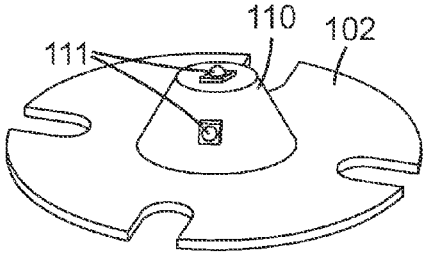
FIG. 11 is a perspective view of a pedestal heat sink having a conical shape.
Figure 12:
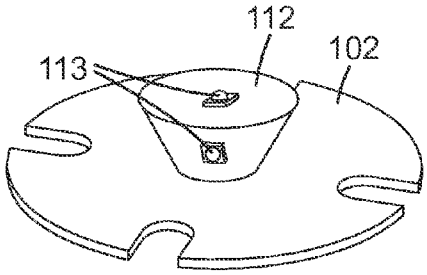
FIG. 12 is a perspective view of a pedestal heat sink having an inverted conical shape.
Figure 13:
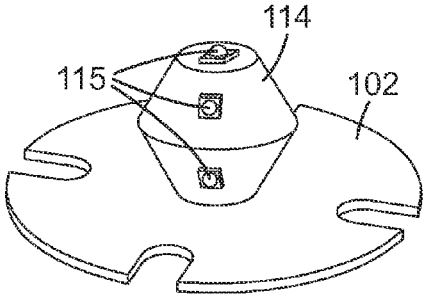
FIG. 13 is a perspective view of a pedestal heat sink having two conical shapes.
Figure 14:
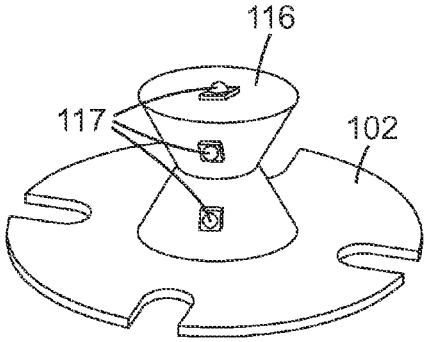
FIG. 14 is a perspective view of another pedestal heat sink having two conical shapes.

FIGS. 11-14 are perspective views illustrating examples of various shapes of pedestal heat sink 106 for the fifth embodiment shown in FIGS. 9 and 10. The pedestal heat sink can be shaped in order to direct light from the solid state light sources in a particular direction to the shell within the interior volume. For example, the pedestal heat sink can be shaped to direct light from the light sources to the shell for substantially uniform distribution of light from outer surface of the shell. FIG. 11 illustrates a pedestal heat sink 110 having a truncated cone shape with solid state light sources 111 on the sides and top of the heat sink. FIG. 12 illustrates a pedestal heat sink 112 having an inverted truncated cone shape with solid state light sources 113 on the sides and top of the heat sink. FIG. 13 illustrates a pedestal heat sink 114 having two truncated cone shapes with solid state light sources 115 on the sides and top of the heat sink. FIG. 14 illustrates a pedestal heat sink 116 also having two truncated cone shapes with solid state light sources 117 on the sides and top of the heat sink. The pedestal heat sink can also be shaped to direct light from the light sources in particular directions by being on a contoured board such as flexible board.

Figure 15:
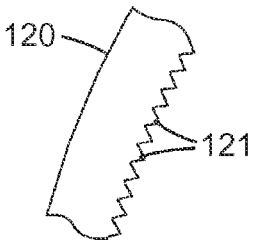
FIG. 15 is a side sectional view of a solid state light shell having texture on an inner surface.
Figure 16:
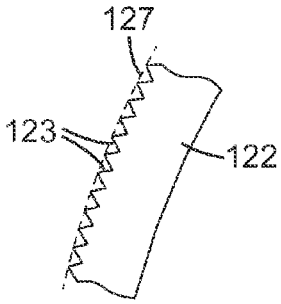
FIG. 16 is a side sectional view of a solid state light shell having texture on an outer surface.
Figure 17:
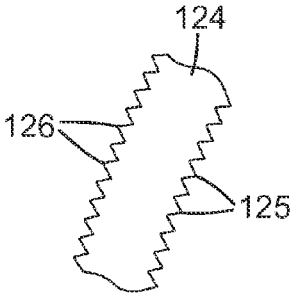
FIG. 17 is a side sectional view of a solid state light shell having texture on inner and outer surfaces.

FIGS. 15-17 are side sectional views illustrating surface texture on a solid state light shell. FIG. 15 illustrates texture 121 on the inner surface of a shell 120. FIG. 16 illustrates texture 123 on the outer surface of a shell 122. A layer 127 such as a transparent thin film can optionally be included over texture 123 with an air gap between layer 127 and texture 123, or layer 127 can be implemented with a low index material applied over texture 123. Layer 127 can be used over texture 123 to provide the shell with, for example, an outer surface having a smooth appearance and feel. FIG. 17 illustrates texture 125 and 126 on the inner and outer surfaces, respectively, of a shell 124. The shell can thus have texture on the first (outer) surface only, the second (inner) surface only, or on both the outer and inner surfaces. Also, the shell can have texture on the entire outer and inner surfaces or have texture on only portions of the outer and inner surfaces.

The texture on the shell preferably protrudes from a surface of the shell and is located on the first (outer) surface of the shell. Alternatively, the texture can be indented into the shell. The texture can be, for example, molded into the shell during formation of it or applied to the shell after it is formed. The texture can include, for example, pyramids, ribs, prisms, cones, half-circles, or other shapes. The pyramids can have, for example, a 90° (or 105° or 60° or other angles) pyramid pattern. The texture redirects light at an angle, and the individual texture features can thus be tailored for overall light redirection from the shell. In particular, the shape, density, and placement of the texture features can be varied to achieve a various light distribution curves or appearances of the light when the light sources are on. For example, the texture can be tailored such that the light distribution curve of the solid state light achieves light distribution properties resembling those properties of an incandescent light bulb. The texture can optionally reflect some light in addition to redirecting and transmitting light.

Figure 18:
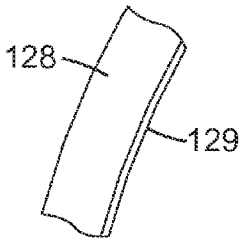
FIG. 18 is a side sectional view of a solid state light shell having a transflective film on an inner surface.

FIG. 18 is a side sectional view of a portion of a solid state light shell 128 having a transflective film 129 on an inner surface. The transflective film can cover the entire inner surface of the shell or only a portion of the inner surface. As with texture, the transflective film can be used to achieve various light distribution curves of the light. The reflectance of the film can be varied based upon the shape of the shell. The transflective film can be on the surface of the shell by being directly on it (in physical contact), separated by an air gap, or separated by other components such as an adhesive or another film. An example of a transflective film is the 3M VIKUITI DBEF-Q Film product from 3M Company, St. Paul, Minn. The shell can alternatively include both surface texture and transflective film.

Figure 19:
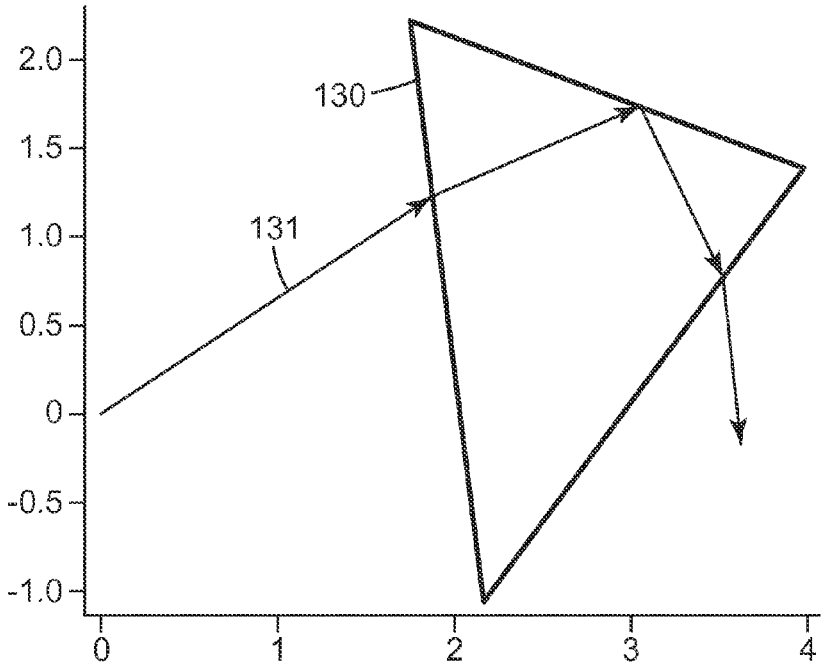
FIG. 19 is a diagram illustrating redirection of light by texture on a light shell.
Figure 20:
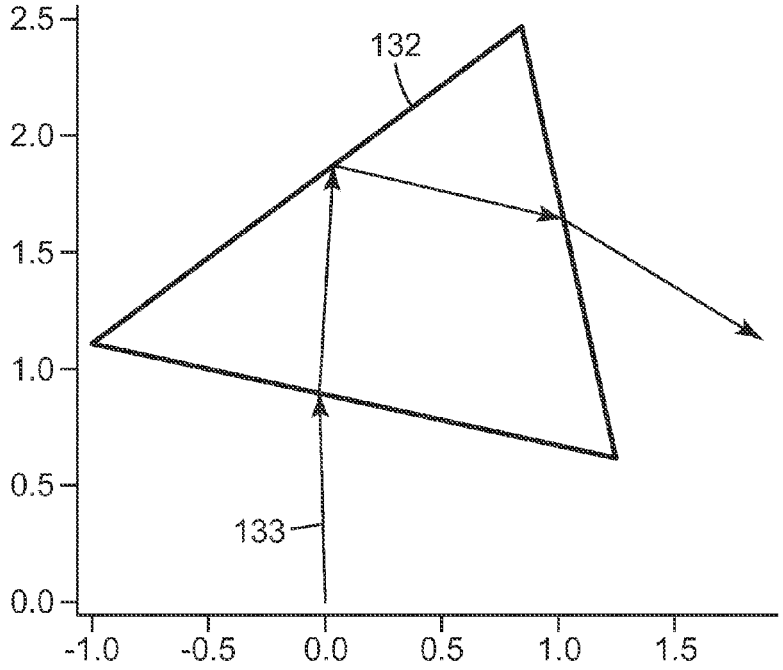
FIG. 20 is another diagram illustrating redirection of light by texture on a light shell.

FIGS. 19 and 20 are diagrams illustrating redirection of light by surface texture on a solid state light shell. FIG. 19 illustrates a texture feature 130 providing for redirection of light as represented by line 131. FIG. 20 illustrates another texture feature 132 providing for redirection of light as represented by line 133. The x- and y-axes in FIGS. 19 and 20 indicate the size of the features in arbitrary units. Texture features 130 and 132 can be implemented with, for example, prisms or pyramids protruding from the outer surface of the shell. By varying the shape of the texture features, for example the angles within prisms or pyramids, and the location of the texture features on the shell, the texture features can be tailored to redirect light in various ways across the shell.

The following are exemplary materials, components, and configurations for the solid state lights described herein.

The light sources can be implemented with LEDs, organic LEDs (OLEDS), or other solid state light sources. The lights can include one light source or multiple light sources. The light sources can be located in different zones on the light source board, for example in a central area and a perimeter as shown in FIGS. 7 and 8, in order to optimize the performance and light distribution curve of the light or achieve a particular appearance of the light when the light sources are on.

The light section can be implemented with, for example, a metal material such as aluminum and with an insulator for the base portion inside the base. The light section can also be implemented with other metal materials or ceramic materials. The light section can function as a heat sink, and a size of the light section can be adjusted to dissipate a particular amount of heat from the light. The light section can have a round or circular shape, as shown, or other shapes depending upon the shape of the shell, for example.

The base can be implemented with, for example, an Edison base for use with conventional light bulb sockets or a base configured for connection to other types of light fixture connections.

The light source boards, including alternative light source boards, can be implemented with a material providing sufficient mechanical support for the light sources and optionally conducting heat from the light sources for use in dissipating the heat. Examples of light source boards include the SMJE-2V12W2P4 (Acrich2) product from Seoul Semiconductor Co., Ltd. The light source boards would have electrical connections with the base and the light sources in order to receive power from the base when connected to a power source and drive the light sources. The light source board in some embodiments has at least one aperture when coupled to the light section, which may be accomplished by the light source board forming an aperture with the light section or having a complete aperture. The light source boards can be coupled to the light section by, for example, being supported by a ridge or other component, or being adhered to a ridge or other component with an adhesive, fasteners, or in other ways.

The driver can be implemented with one or more integrated circuit chips, or other circuit components, having an LED driver or other solid state light source driver. The drivers can be located on the light source board, as shown, or elsewhere on a separate board. Examples of such LED drivers include the driver circuits available from Seoul Semiconductor Co., Ltd.; JMK Optoelectronic Co., Ltd.; and InterLight Optotech Corporation.

The shells can be implemented with, for example, a transparent or translucent material capable of receiving light from the one or more solid state light sources and emitting the light. For example, the shells can be made of an optically suitable material such as acrylic, polycarbonate, polyacrylates such as polymethyl methacrylate, polystyrene, glass, or any number of different plastic materials having sufficiently high refractive indexes. The material can be cast or molded, for example, to form the shells. The surfaces of the shells can optionally be polished. The shells can optionally include bulk scatter elements, such as particles within the shells, to provide for a soft glow appearance when the shells are illuminated by the solid state light sources. Based upon a placement of the light sources, the shells can function as a light guide to transmit light within them, for example by total internal reflection, and can transmit light through the shells, for example from the interior volume through the inner surface and exiting from the outer surface.

The shells can have a single aperture or multiple apertures. Although the lights described above only have apertures in the upper portion, the shells can also or alternatively have apertures in the lower portion. The apertures can have various shapes. For example, the apertures can be in the shape of narrow slits as shown in the lights described above or can be in other shapes such as circles, triangles, or squares.

The top and bottom portions of the shells can be adhered together with an adhesive, for example, or they can otherwise be removably attached together. The shells can have a bulb shape, as shown, or other shapes such as a cylinder or cone. The shells can be composed of multiple sections joined together, for example the upper and lower portions shown, or a single unitary piece of material. The shells can be coupled to the light section by, for example, being supported by a ridge or other component, or being adhered to a ridge or other component with an adhesive, fasteners, or in other ways.

The invention claimed is:

1. A solid state light, comprising:

a shell comprising a material having a first surface and a second surface opposite the first surface, at least one aperture, and texture on the first or second surface, wherein the second surface forms an interior volume;

a light section having a first side, a second side opposite the first side and coupled to the shell, and at least one aperture between the first and second sides;

a light source board coupled to the light section; and at least one solid state light source on the light source board, wherein the light source transmits light into the interior volume, at least a portion of the light exits from the first surface, and the texture redirects the light.

2. The light of claim 1, further comprising a base coupled to the first side of the light section and configured for connection to a power source.

3. The light of claim 1, wherein the light source board has at least one aperture when coupled to the light section.

4. The light of claim 1, wherein the light source board has no aperture when coupled to the light section.

5. The light of claim 1, further comprising a driver circuit on the light source board for driving the light source.

6. The light of claim 1, further comprising a transflective film on at least a portion of the second surface of the shell.

7. The light of claim 1, wherein the texture comprises ribs or pyramids protruding from the first surface of the shell.

8. The light of claim 1, wherein the texture protrudes from the first surface, and further comprising a transparent layer over the texture.

9. The light of claim 1, further comprising a light mixing chamber over the solid state light source.

10. A solid state light, comprising:

a shell comprising a material having a first surface and a second surface opposite the first surface, an edge between the first and second surfaces, at least one aperture, and texture on the first or second surface, wherein the second surface forms an interior volume;

a light section having a first side, a second side opposite the first side and coupled to the shell, and at least one aperture between the first and second sides;

a light source board coupled to the light section; and at least one solid state light source on the light source board at the edge of the shell, wherein the light source transmits light into the edge and into the interior volume, at least a portion of the light exits from the first surface, and the texture redirects the light.

11. The light of claim 10, further comprising a base coupled to the first side of the light section and configured for connection to a power source.

12. The light of claim 10, wherein the light source board has a center opening.

13. The light of claim 10, further comprising a driver circuit on the light source board for driving the light source.

14. The light of claim 10, further comprising a transflective film on at least a portion of the second surface of the shell.

15. The light of claim 10, wherein the texture comprises ribs or pyramids protruding from the first surface of the shell.

16. A solid state light, comprising:

a shell comprising a material having a first surface and a second surface opposite the first surface, an edge between the first and second surfaces, and at least one aperture, wherein the second surface forms an interior volume;

a light section having a first side, a second side opposite the first side and coupled to the shell, and at least one aperture between the first and second sides;

a light source board coupled to the light section; and a first solid state light source on the light source board at the edge of the shell, and a second solid state light source on the light source board within or adjacent the interior volume, wherein the first light source transmits light into the edge, the second light source transmits light into the interior volume, and at least a portion of the light from the first and second light sources exits from the first surface.

17. The light of claim 16, further comprising a base coupled to the first side of the light section and configured for connection to a power source.

18. The light of claim 16, wherein the light source board has at least one aperture when coupled to the light section.

19. The light of claim 16, further comprising a driver circuit on the light source board for driving the first and second light sources.

20. The light of claim 16, further comprising a transflective film on at least a portion of the second surface of the shell.

21. The light of claim 16, wherein the shell has texture on the first or second surface, and the texture redirects the light from the first and second light sources.

22. The light of claim 21, wherein the texture comprises ribs or pyramids protruding from the first surface of the shell.

23. The light of claim 16, further comprising a reflective material between the first and second light sources.

24. A solid state light, comprising:

a shell comprising a material having a first surface and a second surface opposite the first surface, at least one aperture, and texture on the first or second surface, wherein the second surface forms an interior volume;

a light section having a first side, a second side opposite the first side and coupled to the shell, and at least one aperture between the first and second sides;

a light source board coupled to the light section;

a pedestal heat sink on the light source board; and at least one solid state light source on the pedestal heat sink, wherein the light source transmits light into the interior volume, at least a portion of the light exits from the first surface, and the texture redirects the light.

25. The light of claim 24, further comprising a base coupled to the first side of the light section and configured for connection to a power source.

26. The light of claim 24, wherein the light source board has at least one aperture when coupled to the light section.

27. The light of claim 24, further comprising a driver circuit on the light source board for driving the light source, wherein the pedestal heat sink covers the driver circuit.

28. The light of claim 24, further comprising a transflective film on at least a portion of the second surface of the shell.

29. The light of claim 24, wherein the texture comprises ribs or pyramids protruding from the first surface of the shell.

30. The light of claim 24, wherein the pedestal heat sink is shaped to direct light from the light source to the shell for substantially uniform distribution of light from first surface of the shell.

* * * * *